United States Patent [19]

Smith

[11] 4,238,750

[45] Dec. 9, 1980

[54] MECHANICAL TRIP DEVICE FOR A CIRCUIT BREAKER

[75] Inventor: Archibald W. Smith, Peterborough, Canada

[73] Assignee: Canadian General Electric Company Limited, Toronto, Canada

[21] Appl. No.: 54,454

[22] Filed: Jul. 3, 1979

[51] Int. Cl.[3] ..... H01H 75/10; H01H 9/20

[52] U.S. Cl. ..... 335/173; 335/35; 335/169

[58] Field of Search ..... 335/173, 174, 172, 169, 335/167, 171, 35, 164

[56] References Cited

U.S. PATENT DOCUMENTS

| | | | |
|---|---|---|---|
| 2,479,320 | 8/1949 | Cumming et al. | 335/169 |
| 3,940,723 | 2/1976 | Horikawa | 335/174 |
| 4,001,742 | 1/1977 | Jencks et al. | 335/173 |

*Primary Examiner*—Harold Broome

*Attorney, Agent, or Firm*—William Freedman

[57] ABSTRACT

In a power circuit breaker a trip mechanism is provided normally to oppose the large opening forces associated with the separable contacts of the breaker and to hold the contacts closed. The trip mechanism in response to overload current conditions collapses and trips open the breaker contacts. Forces related to the opening force of the breaker contacts are present throughout the trip mechanism when the contacts are closed. The trip mechanism provides two eccentric latch mechanisms in series each of which reduce the magnitude of the forces acting in the trip mechanism that are related to the opening force. The two latch mechanisms are each mounted to a pivot for rotation therewith. A force related to the opening force is applied against each latch mechanism. Because the pivot for each latch mechanism is eccentric to the line of force acting against the latch mechanism, the force translates into a rotational force that tends to rotate the latch mechanism and pivot. The rotational force is considerably smaller in magnitude than the force acting against the latch mechanism. By utilizing the two eccentric latch mechanisms connected in series, the trip mechanism becomes a relatively simple and inexpensive device.

15 Claims, 5 Drawing Figures

MECHANICAL TRIP DEVICE FOR A CIRCUIT BREAKER

This invention relates to power circuit breaker having large opening forces associated with the breaker contacts. In particular, this invention deals with a trip mechanism for power circuit breakers.

Previous trip mechanisms for circuit breakers have included a magnetic trip latch. The magnetic trip latch usually includes a stationary magnetic housing and a movable armature. The opening force of the breaker contacts acts against the armature tending to pull the armature away from the stationary magnetic housing. A permanent magnet and an exciting coil surrounding the permanent magnet normally provide a magnetic field through the stationary magnetic housing and the movable armature. This magnetic field holds the armature against the stationary housing in opposing relation to the opening force acting on the armature. A trip coil located in the housing near the armature provides a magnetic field which opposes the magnetic field of the permanent magnet and exciting coil when an overload current condition in the breaker is present. As a result, the magnetic field in the armature diminishes and the armature moves away from the stationary magnetic housing. This movement allows the opening force associated with the breaker contacts to open the circuit breaker.

Some of the utilities have expressed a desire to include in the stationary magnetic housing a second or a back-up trip coil so as to provide more reliable operation in the event that the first trip coil malfunctions. However, the disadvantage with the double trip coil is that under certain trip conditions the armature fails to move and allow the breaker contacts to open within a predetermined safe time interval.

It is therefore an object of this invention to provide a trip mechanism which has reliable operation and includes an alternate device to the magnetic trip latch.

It is another object of this invention to provide a trip mechanism that is less expensive to manufacture than a trip mechanism that includes the magnetic trip latch.

Briefly, the present invention provides a trip mechanism that normally holds the separable contacts of a power circuit breaker closed against the opening force associated with the contacts which tends to open the contacts. The trip mechanism includes a collapsible means, a series means, a first latch means, a second latch means and a trip device. The collapsible means is movable between a holding position that holds the separable contacts closed and a collapsed position that allows the opening force to open the contacts. The first latch means is mounted on a shaft for rotation with the shaft. The first latch means has a first end portion which includes a first arcuate surface that normally supports the collapsible means in the holding position so that a first resultant bias force, related to the opening force, is exerted along a radius for the first arcuate surface. The shaft has an axis of rotation that is eccentric to the first end portion which causes the exerted first resultant bias force to be translated into a first rotatable bias force that rotatably biases the first latch means about the axis of the shaft. The series means is mounted on the shaft, rotates with the shaft, and translates the first rotatable bias force into a second resultant bias force. The second latch means is mounted to a pivot and has a second end portion which includes a second arcuate surface that normally acts as a stop for the series means to prevent the shaft from rotating. The pivot has an axis which is eccentric to the second end portion. The second latch means translates the second resultant bias force into a second rotatable bias force. This second rotatable bias force rotatably biases the second latch means and the pivot about the axis of the pivot. The trip device normally prevents the second latch means from rotating by opposing the second rotatable bias force. Thus, forces related to the opening force are present throughout the trip mechanism when the separable contacts of the power circuit breaker are closed. The trip device, in response to an overload current condition allows the second latch means to rotate and move the second end portion. Movement of the second end portion permits the series means, the shaft, and the first end portion of the first latch means to move simultaneously. Movement of the first end portion allows the collapsible means to collapse and the separable contacts to open. The significance of this trip mechanism is that it provides a reliable alternate device to the magnetic trip latch device because each of the first and second latch means of the trip mechanism rotate about an axis that is eccentric to an end portion for that latch means which considerably reduces the magnitude of the bias force, related to the opening force, acting on the next member of the trip mechanism thereby simplifying and reducing the cost of the trip mechanism.

In a power circuit breaker having large opening forces associated with its separable contacts, a trip mechanism normally holding the contacts closed and collapsing to permit said contacts to open when an overload current condition is present, the trip mechanism comprising: a collapsible means operable with the contacts and movable between a collapsed position permitting the opening force to open the contacts and a normal position holding the contacts closed, the collapsible means biased towards its collapsed porition by a first resultant bias force related to the opening force; a first latch means having a first end portion for engaging the collapsed means, the first latch means mounted to a shaft which is eccentric to the first end portion, the first latch means movable between a release position therefor permitting the collapsible means to move into its collapsed position and a support position therefor supporting the collapsible means in its normal position whereby the first end portion translates the first resultant bias force into a first rotatable bias force of reduced magnitude which rotatably biases the first latch means towards its release position; a second latch means having a second end portion serially operable with the first latch means, the second latch means mounted to a first pivot which is eccentric to the second end portion, the second latch means movable between a release position therefor permitting the first latch means to move into its release position and a stop position therefor holding the first latch means in its normal position whereby the second end portion translates a second resultant force acting therein which is related to the first rotatable bias force into a second rotatable bias force of reduced magnitude which rotatably biases the second latch means towards its release position; and a trip device operable with the second latch means and in response to the overload current condition movable from a normal position opposing the second rotatable bias force into a trip position permitting the second rotatable bias force to move the second latch means into its release position.

For a better understanding of the nature and objects of the invention, reference may be had to the accompanying diagrammatic drawings for a preferred embodiment in which.

Figure 1:
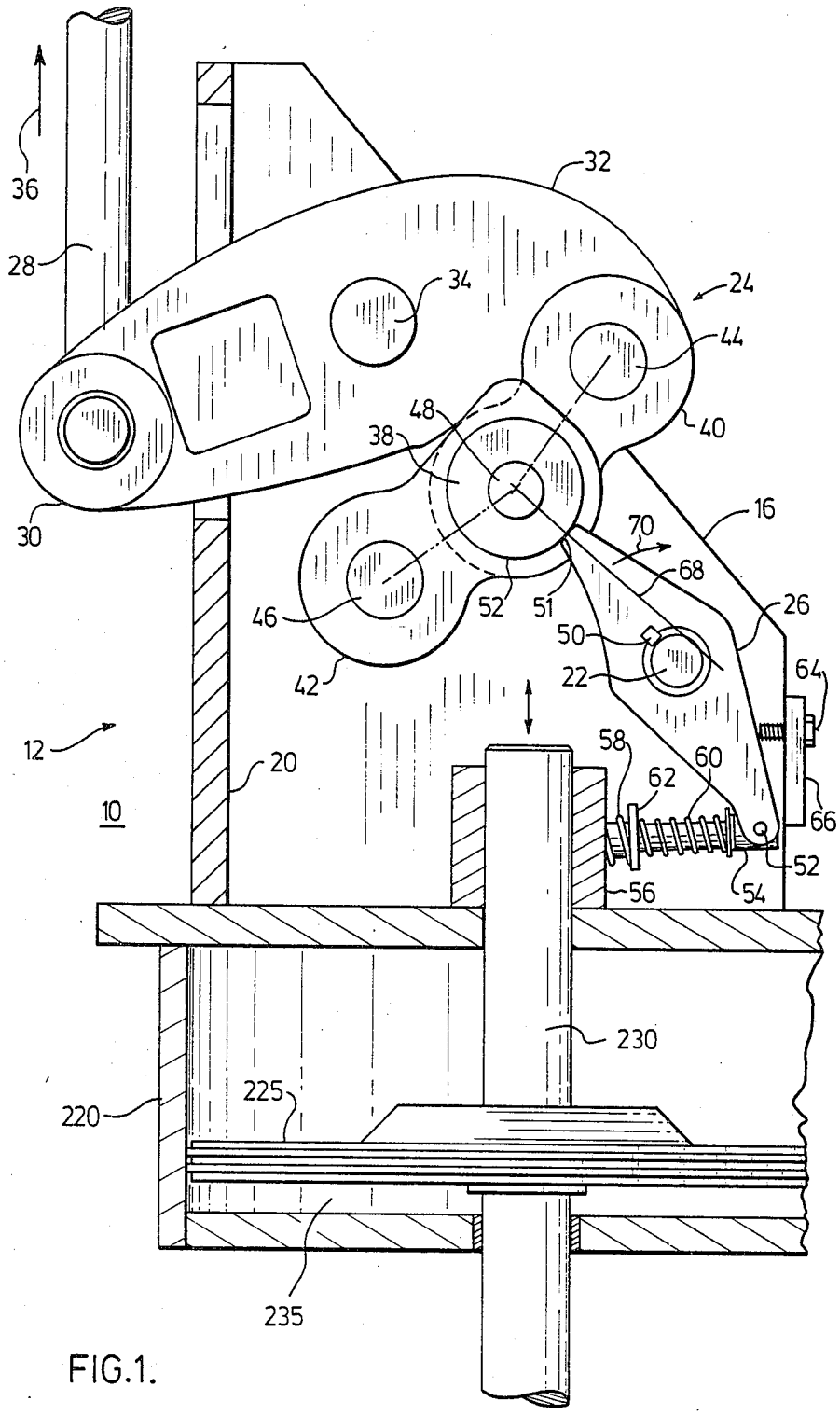
FIG. 1 is a side view showing a portion of the trip mechanism in a position that normally holds the separable contacts of the power circuit breaker closed.
Figure 2:
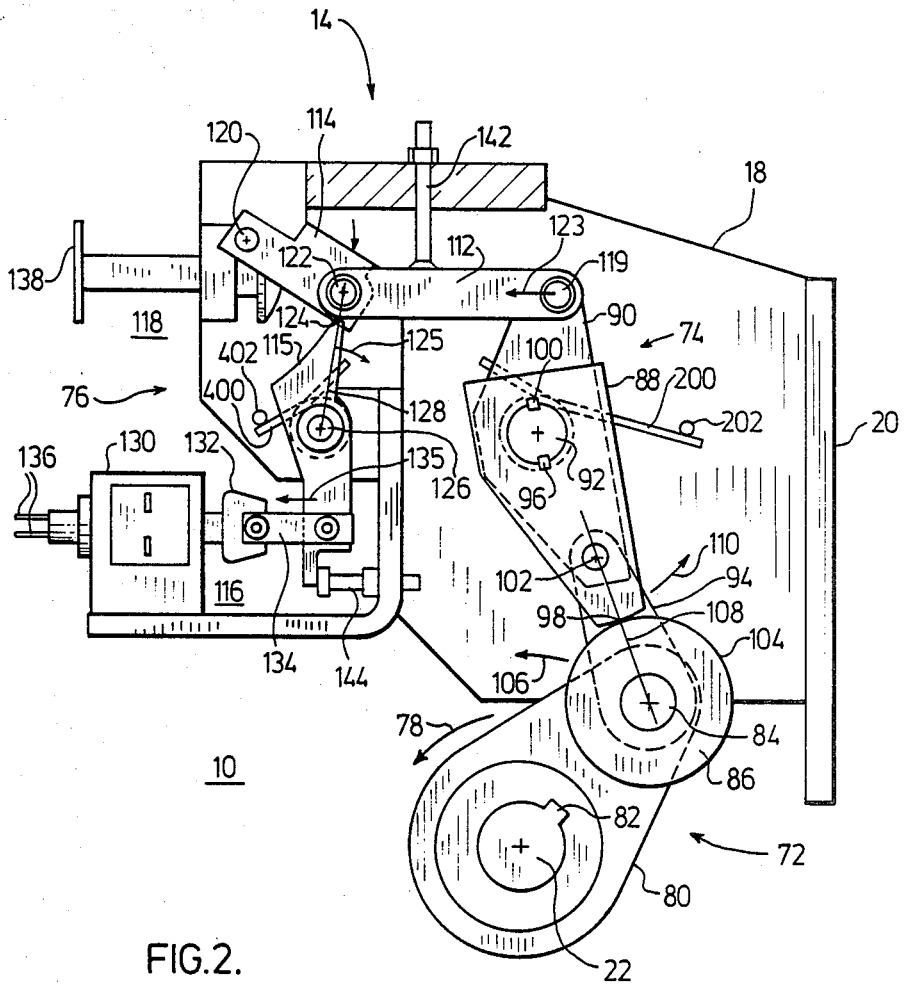
FIG. 2 is a side view, opposite to the view of FIG. 1, showing the remaining portion of the trip mechanism in a position that normally holds the separable contacts of the power circuit breaker closed.

Referring now to FIGS. 1 and 2 there is shown a trip mechanism 10 for a power circuit breaker. Trip mechanism 10 is divided into sections 12 and 14 by two dividing walls 16 and 18. Walls 16 and 18 are mounted to frame 20. Sections 12 and 14 are interconnected by means of shaft 22 extending through wall 16.

Referring now to FIG. 1 section 12 of trip mechanism 10 includes a collapsible means 24 and a first trip latch means 26. The collapsible means has a lever rod 28 connected via roller 30 to crank arm 32. Crank arm 32 is pivotally connected to fixed pivot 34 which extends out from wall 16. The collapsible means also has a roller 38, link 40 and link 42. Link 40 is pivotally connected to crank 32 at 44. Link 42 is pivotally connected to fixed pivot 46 which extends out from wall 16. Roller 38 is pivotally mounted on pivot pin 48. Links 40 and 42 are also pivotally connected with pivot pin 48. The first latch means 26 is mounted on shaft 22 for rotation therewith by means of key 50. The first latch means 26 includes a first end portion 51 which has a first ground arcuate surface for engaging roller 38 so that end portion 51 is in supporting relation with a portion of surface 52 of roller 38. An axis for shaft 22 is shown in FIG. 1 eccentric to the first end portion 51. The first latch means 26 is pivotally connected at 52 to guide arm 54. Guide arm 54 is movable in and out of an aperture (not shown) in mounting structure 56. Guide arm 54 has a buffer spring 58 and a holding spring 60 mounted thereon and separated by flange 62. The function of guide arm 54 and springs 58 and 60 will be further discussed later. Positioning screw 64 locates the first latch means 26 in a suitable predetermined position.

It should be understood that lever rod 28 is operably connected to separable contacts (not shown) of the power circuit breaker by suitable linkage in the power circuit breaker. The power circuit breaker of the preferred embodiment comprises a three phase circuit breaker having its separable contacts submerged in oil. The circuit breaker is rated in the order of 250 kilo-volts and has and opening force associated with the separable contacts in the order of 30,000 pounds. The opening force pulls on rod 28 tending to move rod 28 vertically in the direction of arrow 36. In operation the trip mechanism normally holds the contacts closed by opposing the opening force of the separable contacts. The opening force acting on rod 28 is translated into an angular force which rotatably biases crank arm 32 about pivot 34. The rotatable bias acting on crank arm 32 is translated by links 40 and 42 and roller 38 into a first resultant bias force, related to the opening force and smaller in magnitude than the opening force being exerted along a radius 68 for the first arcuate surface of the first end portion 51 where the portion of surface 52 of roller 38 of the first roller means 24 abuts the first end portion 51. In FIG. 1 the first latch means 26 normally supports the collapsible means 24 in a holding position where the separable contacts are held closed by having the first end portion 51 in supporting relation with a portion of surface 52. The first resultant force exerted along radius 68 is translated into a first rotatable bias force because the radius 68 passes to the side of the axis of shaft 22. This first rotatable bias force rotatably biases the first latch means 26 in the clockwise direction of arrow 70. The magnitude of the rotatable bias force is, of course, considerably reduced from that of resultant bias force. Because the first latch means 26 is keyed onto shaft 22, shaft 22 is also rotatably biased about its axis. The first latch means 26 and the shaft 22 are normally prevented from rotating by section 14 (FIG. 2) of the trip mechanism 10 now to be described.

Referring now to FIG. 2, the mechanical trip latch or section 14 of trip mechanism 10 includes a series means 72, a second latch means 74 and a trip device 76 which normally co-operate to prevent shaft 22 from rotating. Because the side view of FIG. 2 is opposite to that of FIG. 1, the rotatable bias of the first resultant bias force acting on shaft 22 is in the counter-clockwise direction as shown by arrow 78. The series means 72 includes a link arm 80 having one end mounted to the shaft 22 for rotation therewith by key 82. The other end of link arm 80 is pivotally connected to pivot pin 84. The series means 72 further includes a roller 86 pivotally mounted on pivot pin 84. Roller 86 is rotatably biased in the direction of arrow 106 because of the rotatable bias on shaft 22, and link arm 80 translating this bias into a second resultant bias force at roller 86. The second latch means 74 includes a first latch member 88, a second latch member 90, and a link arm 94. The first latch member 88 is mounted to a pivot pin 92 for rotation therewith by means of key 96 and has a second end portion 98 that includes a second ground arcuate surface. The second latch member 90 is mounted to the pivot pin 92 for rotation therewith by means of key 100. Pivot pin 92 is rotatably mounted in wall 18. Link arm 94 has one of its ends pivotally connected to pivot pin 84 and the other of its ends pivotally connected at 102 to the second latch member 90. The second latch means 74 normally acts as a stop for roller 86 of the second roller means 72 by having the second end portion 98 of the first latch member 88 engaging roller 86 so that the second end portion 98 is in stopping relation with a portion of surface 104 of the roller 86. The second latch means 74 in acting as a stop prevents roller 84 from rotating in a counter-clockwise direction as indicated by arrow 106. The stopping relation causes the second resultant force to be exerted along a radius 108 for the second arcuate surface 98 where the portion of surface 104 of roller 86 abuts the second arcuate surface 98. Because the axis for pivot 92 is eccentric to the second arcuate surface 98, the second resultant force is translated into a second rotatable bias force that rotatably biases the first latch member 88 and the second latch member 90 of the second latch means 74 about an axis for the pivot pin 92 in the direction of arrow 110. The magnitude of the rotatable bias is considerably reduced again from that of the resultant bias force. Rotation of the second latch means 74 about an axis for pivot 92 is normally prevented by trip device 76.

Figure 3:
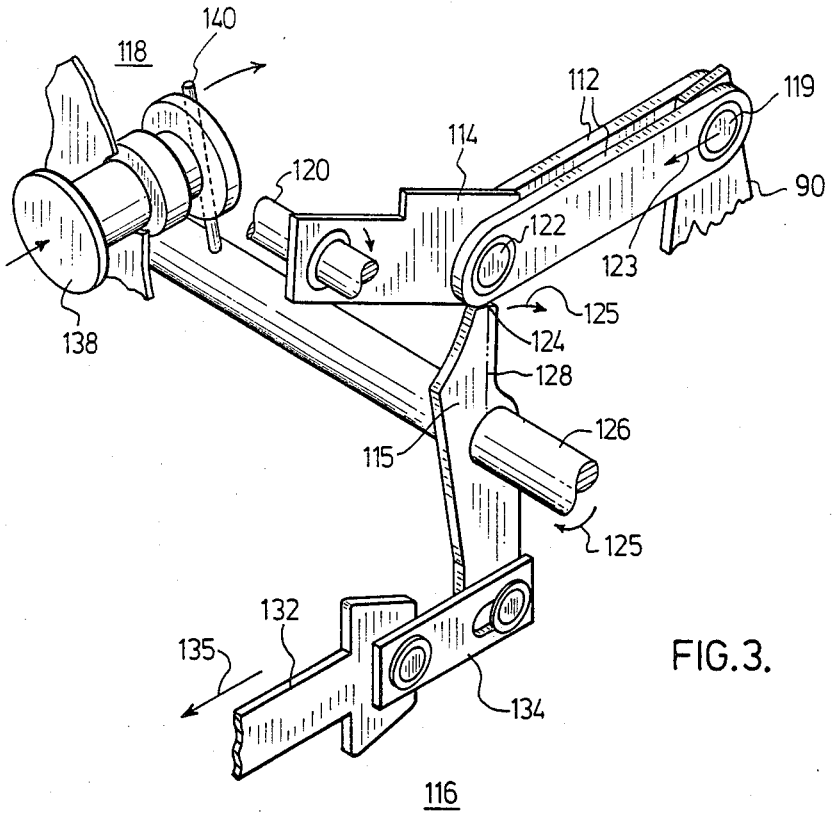
FIG. 3 is an isometric view of the trip device shown in FIG. 2.

Referring now to FIGS. 2 and 3 the trip device 76 is shown to comprise a first link member 112, a second link member 114, a trip latch 115 and trip means 116 and 118. The first link member 112 is pivotally connected at 119 to the second latch member 90. The second link member 114 is pivotally connected to a fixed pivot 120. The first link member 112 and the second link member 114 are pivotally connected to mutual pivot 122. The trip latch 115 has a third end portion 124 that includes a third ground arcuate surface normally supporting the first and second link members 112 and 114 at mutual pivot 122. The trip latch 115 is mounted to a fixed pivot pin 126 for rotation therewith. Actuation of trip means 116 or 118 causes trip latch 115 to rotate about an axis for pivot pin 126. The first link member 112 of the trip latch means 76 normally acts against a third resultant bias force translated from the second rotatable bias force associated with the second latch means 74. The third resultant bias force is exerted against the first link member 112 substantially in the direction indicated by arrow 123. The link members 112 and 114 normally translate this third resultant bias force into a fourth resultant bias force, which is exerted along a radius 128 for the third end portion 124. The axis for pivot pin 126 lies along the radius 128 so that pivot pin 126 is concentric with the third end portion 124. Hence the fourth resultant bias force is opposed by trip latch 115 and pivot pin 126 and the fourth resultant bias force does not rotatably bias the trip latch 115. Trip means 116 comprises a solenoid coil 130 and a solenoid plunger 132. Plunger 132 is connected by toggle link 134 to trip latch 115. Trip coil 130 is energized in response to a signal representing an overload current condition being present on wires 136. Energization of trip coil 130 pulls plunger 134 in the direction of arrow 135 and rotates trip latch 115 and pin 126 in the direction of arrows 125. Trip means 118 comprises a manual plunger 138 which may be activated by a human operator to move against pin 140. Because pin 140 is mounted in pivot pin 126, the movement of manual plunger 138 against pin 140 rotates pivot pin 126 and trip latch 115 in the direction of arrows 125. Positioning screws 142 and 144 are provided to respectively position first link member 112 and trip latch 115 each in a predetermined position.

Briefly, the operation of the trip mechanism is now summarized. Referring now to FIGS. 1 and 2, the trip mechanism 10 normally holds separable contacts of a power circuit breaker closed by opposing the opening force acting in the direction of arrow 36 on rod 28. This opening force rotatably biases crank 32 about pivot 34. This results in the first resultant bias force related to the opening force being exerted along radius 68 of the first end portion 51 of the first latch means 26. The first latch means 26 supports the collapsible means 24 in the position shown in FIG. 1 thus preventing collapsible means 24 from collapsing. Because of the geometry of crank 32, links 42, 44 and roller 52, the first resultant bias force acting along radius 68 is considerably smaller in magnitude than the opening force acting in the direction of arrow 36. The first resultant bias force is translated into a rotable bias force that rotatably biases the first latch means 26 and shaft 22 clockwise. Referring to FIG. 2, the series means 72 and shaft 22 are rotatably biased in the direction of arrow 78 since FIG. 2 is the opposite side view to FIG. 1. This results in roller 86 being rotatably biased in the direction of arrow 106. However, the second end portion 98 of the second latch means 74 acts as a stop to prevent roller 86 from moving whereby the second resultant bias force, translated from the first rotatable bias force by series means 72, is exerted along radius 108 of the second end portion 98. The second resultant bias force is translated by the second latch means 74 into a second rotatable bias force which is considerably smaller in magnitude than the second resultant bias force and rotatably biases the second latch means 74 about pivot 92 in the direction of arrow 110. The rotation of the second latch means 74 is prevented by the trip latch means 76 which acts against a third resultant bias force exerted thereon from the second latch means 74. The third resultant bias force is exerted in the direction of arrow 123 resulting in a fourth resultant bias force acting along radius 128 of the third end portion 124. Since pivot 126 is positioned along radius 128, trip latch 115 holds itself in position supporting mutual pivot 122. As an example, the opening force acting in the direction of arrow 36 may be in the order of 30,000 pounds, the first resultant force exerted along radius 68 may be in the order of 10,000 pounds, the second resultant force exerted along radius 108 may be in the order of 3,000 pounds, and the fourth resultant force exerted along radius 128 may be in the order of 300 pounds.

Figure 4:
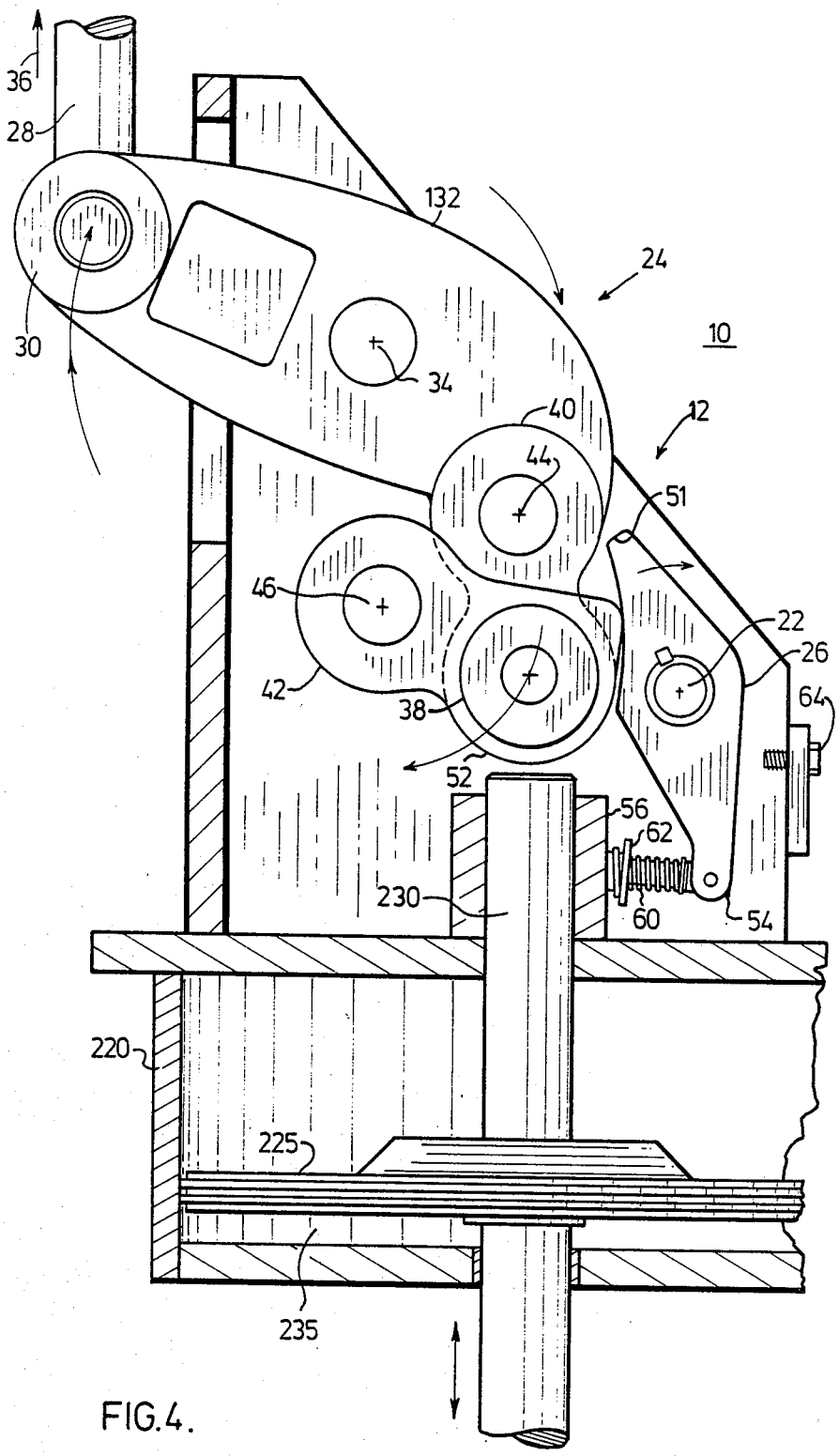
FIG. 4 is a side view that corresponds to FIG. 1 but shows the trip mechanism in its collapsed position; and, FIG. 5 is a side view that corresponds to FIG. 2 but shows the trip mechanism in its collapsed position.
Figure 5:
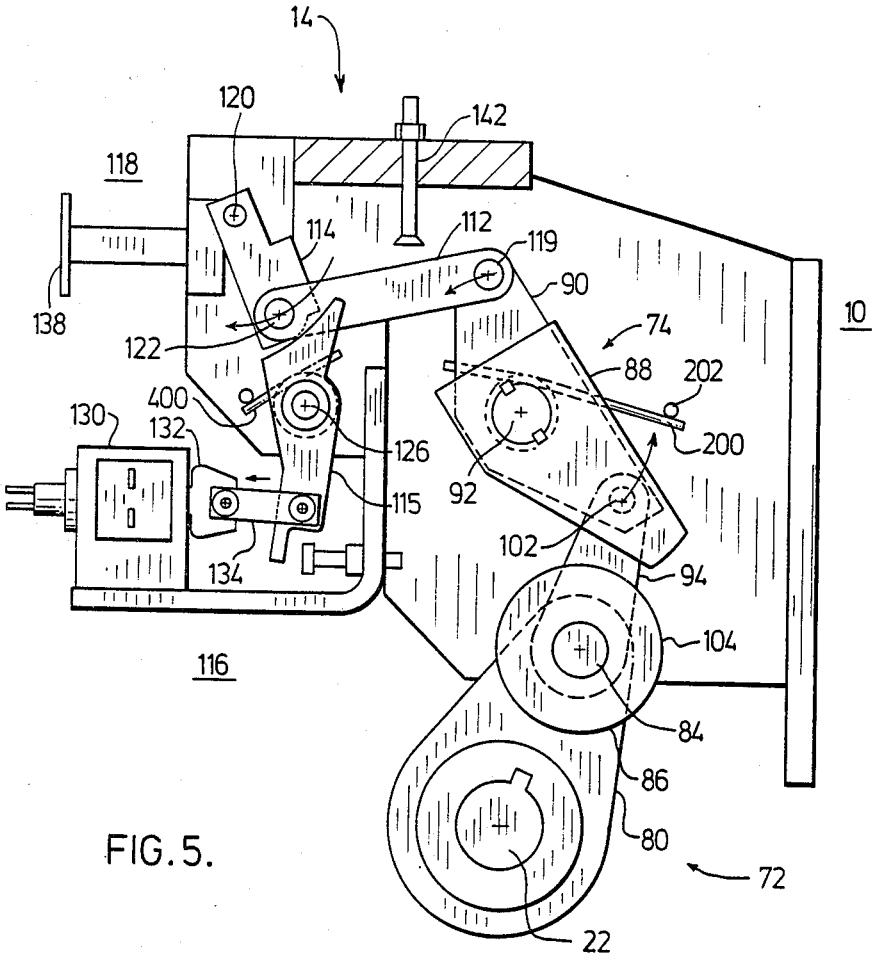

The trip operation of the trip mechanism 10 is now described with reference to FIGS. 1, 2, 4 and 5. In order to trip the trip mechanism 10 either a force is applied against manual plunger 138 to rotate latch 115 or in response to an overload current condition solenoid coil 130 is energized pulling plunger 132 and rotating trip latch 115 and pivot 126 clockwise. The rotation of trip latch 115 moves the third end portion 124 out of supporting relation with mutual pivot 122 permitting the third and fourth resultant bias forces to collapse mutual pivot 122 and link members 112, 114 downwardly. Hence the trip latch means acts as a collapsible stop. After the trip latch has collapsed the second rotatable bias force acting on the second latch means rotates the second latch means clockwise about pivot 92 causing the second end portion 98 to move out of stopping relation with surface 104 of roller 84. When the second latch means 74 no longer acts as a stop for the series means 72, the roller 86 and shaft 22 rotate counter clockwise (FIGS. 2 and 5). Link arm 94 limits the travel of the series means 72 with respect to the second latch means 74. Link arm 94 also acts as a guide during the resetting operation. A spring 200 is mounted on pivot 92 and has a stop 202 extending from wall 18. Spring 200 acts to dampen the movement of the second latch means 74 and the series means 72. The rotation of shaft 22 counter clockwise in FIGS. 2 and 5 becomes a clockwise rotation in FIGS. 1 and 4 which rotates the first latch means 26 clockwise. Buffer spring 58 compresses to dampen the rotational movement of the first latch means 26. Clockwise rotation of the first latch means results in the first end portion 51 moving out of supporting relation with surface 52 of roller 38. This permits the crank arm to rotate clockwise about pivot 34 and collapse links 40 and 42 toward one another as shown in FIG. 4. In FIG. 4 the collapsible means 24 is shown in its collapsed position. As the first roller means collapses, rod 28 moves in the direction of arrow 36 and permits the opening force to open the separable contacts of the circuit breaker. Therefore, once the trip device moves into its trip position, the second latch means, the second series means and the first latch means, and the collapsible means move in sequence to permit the opening force to open the separable contacts.

The reset operation of the trip mechanism is now described. To reset the trip mechanism 10 a force must be applied that counters the opening force associated with the contacts. A reset means comprising a pneumatic cylinder and piston may be used to counter the opening force which is in the order of 30,000 pounds. Such a cylinder is shown in FIGS. 1 and 4 at 220 having a piston 225. A shaft 230 for the piston 225 moves up against roller 38 (see FIG. 4) as air is forced into chamber 235 to expand chamber 235. As the shaft 230 moves upwardly it forces the collapsible means upwardly back into its position shown in FIG. 1 and holds it there for a short time interval. During this time interval buffer spring 58 and holding spring 60 expand pushing guide arm 54 against the first latch means 26. This rotates the first latch means 26 and shaft 22 back into their position shown in FIG. 1 predetermined by positioning screw 64. As shaft 22 rotates so does the series means 72. Spring 200 acts to rotate the second latch means 74 clockwise and link arm 94 guides the second end portion 98 back into stopping relation with surface 104 of roller 86. The rotation of the second latch means also moves the first and second links 112, 114 back into their respective positions shown in FIG. 2. During the reset operation trip means 116 and 118 should not be activated. Spring 400 is mounted to pivot 126 and has a stop 402 extending from wall 18 associated therewith. When the link members 112, 114 move back into their positions shown in FIG. 1 predetermined by positioning screw 142, the spring 400 rotates the pivot 126 and trip latch 115 so as to bring the third end portion 124 back into supporting relation with mutual pivot 122. The position of latch 115 is predetermined by positioning screw 144. After the short time interval shaft 230 descends leaving the trip mechanism in its normal position shown in FIGS. 1 and 2. Should an overload condition still exist, then the trip mechanism trips again. In the preferred embodiment the solenoid coil takes about 6 milli-seconds to activate movement of the solenoid plunger in response to an overload current condition. The trip mechanism requires about 24 milli-seconds to open the separable contacts.

As has been previously noted the trip mechanism of this invention includes an alternate device for the magnetic trip latch device. It is the mechanical trip latch shown in section 14 of the trip mechanism 10 that replaces the prior magnetic latch. Accordingly, it should be understood that although section 12 of the trip mechanism 10 has been utilized with the prior magnetic latch it is believed to form an operable part of the present invention when used with the mechanical trip latch of section 14 shown in the drawings.

It should be understood that the foregoing has been a description of a preferred embodiment and that alternate embodiments thereto may be readily apparent to to a man skilled in the art in view of the disclosure. Accordingly, the invention is to be limited to that which is claimed in the accompanying claims.

What I claim as new and desire to secure by Letters Patent of the United States is:

1. In a power circuit breaker having large opening forces associated with its separable contacts, a trip mechanism normally holding the contacts closed and collapsing to permit said contacts to open when an overload current condition is present, the trip mechanism comprising:

a collapsible means operable with the contacts and movable between a collapsed position permitting the opening force to open the contacts and a normal position holding the contacts closed, the collapsible means biased towards its collapsed position by a first resultant bias force related to the opening force, a first latch means having a first end portion for engaging the collapsible means, the first latch means mounted to a shaft which is eccentric to the first end portion, the first latch means movable between a release position therefor permitting the collapsible means to move into its collapsed position and a support position therefor supporting the collapsible means in its normal position whereby the first end portion translates the first resultant bias force into a first rotatable bias force of reduced magnitude which rotatably biases the first latch means towards its release position, a second latch means having a second end portion serially operable with the first latch means, the second latch means mounted to a first pivot which is eccentric to the second end portion, the second latch means movable between a release position therefor permitting the first latch means to move into its release position and a stop position therefor holding the first latch means in its normal position whereby the second end portion translates a second resultant force acting thereon which is related to the first rotatable bias force into a second rotatable bias force of reduced magnitude which rotatably biases the second latch means towards its release position, and a trip device operable with the second latch means and in response to the overload current condition movable from a normal position opposing the second rotatable bias force into a trip position permitting the second rotatable bias force to move the second latch means into its release position.

2. The circuit breaker of claim 1 wherein the trip device comprises:

a first link member, a second link member, a trip latch and trip means;

said first link member being pivotally connected at one of its ends to the second latch means;

said second link member being pivotally connected at one of its ends to a first fixed pivot, said first and second link members being pivotally connected to a mutual pivot;

said trip latch having a third end portion supporting said mutual pivot when the trip device is in its normal position a trip bias force related to the second rotatable bias force being exerted on the third end portion, said trip latch being mounted to a second pivot that is concentric to the third end portion; and said trip means in response to an overload current condition moving the trip device into its trip position by rotating said trip latch about the second pivot causing said mutual pivot to move and to collapse said first and second link members which allows the second latch means to rotate.

3. The circuit breaker of claim 2 wherein said trip means comprises a solenoid coil and a solenoid plunger attached to the trip latch, said coil being energized during the overload current condition which moves said plunger and rotates said trip latch.

4. The circuit breaker of claim 2 wherein a spring bias means is operable with the second pivot for biasing said trip latch into a position to support said mutual pivot whereby the trip device moves into its normal position prior to bias forces, related to the opening force, being present in the trip mechanism when the trip mechanism is reset.

5. The circuit breaker of claim 1 wherein said second latch means comprises:

a first latch member mounted to said first pivot for rotation therewith, said first latch member including said second end portion, and a second latch member mounted to said first pivot for rotation therewith and having a pivotal connection to said trip device.

6. The circuit breaker of claim 1 wherein said second latch member has pivotal connection to one end of a first link arm, said first link arm having its other end pivotally connected to a series means mounted on said shaft, said first link arm guiding the second latch means back into its stop position when the trip mechanism is reset, and a spring bias means is operable with said first pivot for biasing said second latch means into its stop position prior to bias forces, related to the opening force, being present in the trip mechanism when the trip mechanism is reset.

7. The circuit breaker of claim 6 wherein the series means includes a second link arm having one end thereof mounted to said shaft and the other end thereof pivotally connected to a pivot pin, a roller pivotally connected to the pivot pin for engagement with said second end portion when said second latch means is in its stop position, and said first link arm having its other end pivotally connected to said pivot pin.

8. In a power circuit breaker having large opening forces associated with its separable contacts, a trip mechanism normally holding the contacts closed and collapsing to permit said contacts to open when an overload current condition is present, the trip mechanism comprising:

a collapsible means, a first latch means, a series means, a second latch means and a trip device, the collapsible means operably connected with the contacts and having normal and collapsed positions, said collapsible means in the collapsed position permitting the opening force to open the contacts and in the normal position precluding the opening force from opening the contacts, said collapsible means biased towards its collapsed position by a first resultant bias force related to the opening force and smaller in magnitude than the opening force, the first latch means having a first end portion for engaging the collapsible means, the first latch means mounted to a shaft which is eccentric to the first end portion, the first latch means having support and release positions, the first latch means in its release position permitting the first resultant force to move the collapsible means into the collapsed position and in the support position supporting the collapsible means in its normal position by having the first end portion translate the first resultant bias force acting thereon into a first rotatable bias force of reduced magnitude which rotatably biases the first latch means towards its release position, the series means mounted on said shaft and operable to connect the first latch means in series with the second latch means and to translate the first rotatable bias force into a second resultant bias force, the second latch means having a second end portion for engaging the series means, the second latch means mounted to a first pivot which is eccentric to the second end portion, the second latch means having stop and release positions, the second latch means in its release position permitting the first rotatable bias force to move the first latch means into its release position and in the stop position holding the first latch means in its normal position by having the second end portion translate the second resultant bias force into a second rotatable bias force of reduced magnitude which rotatably biases the second latch means towards its release position, the trip device operable with the second latch means and having a normal position opposing the second rotatable bias force and a trip position permitting the second rotatable bias force to move the second latch means into its release position whereby the first latch means and collapsible means move sequentially into their respective release and collapsed positions, the trip device moving from its normal position to its trip position in response to the presence of the overload current condition.

9. The circuit breaker of claim 8 wherein:

the first end portion has a first arcuate surface for engaging the collapsible means so that the first resultant force is exerted along a radius for the first arcuate surface and said shaft has an axis eccentric to the first arcuate surface, and the second end portion has a second arcuate surface for engaging the series means so that the second resultant force is exerted along a radius for the second arcuate surface and said first pivot has an axis eccentric to the second arcuate surface.

10. The circuit breaker of claim 9 wherein said second latch means comprises:

a first latch member mounted to said first pivot for rotation therewith, said first latch member including said second end portion, a second latch member mounted to said first pivot for rotation therewith said second latch member having a pivotal connection to said trip device, said second latch member having another pivotal connection to one end of a first link arm; and, said first link arm having its other end pivotally connected to said series means, said first link arm guiding the second end portion back into engagement with said series means when the trip mechanism is reset.

11. The circuit breaker of claim 10 wherein a first spring bias means is provided that is operable with said first pivot for biasing said second latch means into its stop position to engage said series means prior to bias forces, related to the opening force, being present in the trip mechanism when the trip mechanism is reset.

12. The circuit breaker of claim 11 wherein the series means comprises a second link arm having one end thereof mounted to said shaft for rotation therewith and the other end thereof pivotally connected to a pivot pin, a roller pivotally connected to the pivot pin for engaging the second end portion, and said first link arm having its other end pivotally connected to said pivot pin.

13. The circuit breaker of claim 11 wherein the trip device comprises:

a first link member, a second link member a trip latch, and a trip means;

said first link member being pivotally connected at one of its ends to said second latch member;

said second link member being pivotally connected at one of its ends to a first fixed pivot, said first and second link members being pivotally connected to a mutual pivot;

said trip latch having a third end portion that includes a third arcuate surface and supports said first and second link members at said mutual pivot when the trip device is in its normal position, said first and second link members operable for translating the second rotatable bias force into a third resultant bias force that is exerted along a radius for the third end portion, said trip latch being mounted to a second pivot that is concentric to the third arcuate surface; and, said trip means in response to the overload current condition moving into its tripping position by rotating said trip latch about the second pivot so as to disengage the trip latch from the mutual pivot causing the mutual pivot to move and to collapse said first and second link members which allows the second latch means to rotate into its release position.

14. The circuit breaker of claim 13 wherein a second spring bias means is operable with the second pivot for biasing said trip latch into a position to support said mutual pivot whereby the trip device moves into its normal position prior to any forces, related to the opening force, being present in the trip mechanism when the trip mechanism is reset.

15. The circuit breaker of claim 14 wherein said first latch means is provided with a third spring bias means which moves the first end portion into its support position and simultaneously rotates said shaft to bring said series means into engagement with said second arcuate end portion; and said circuit breaker further comprising a reset means operable with the collapsible means to close the separable contacts and to momentarily oppose the opening force of the contacts whereby the first, second and third spring bias means reset said trip mechanism.

* * * * *